United States Patent [19]

Astolfi

[11] Patent Number: 4,704,814

[45] Date of Patent: Nov. 10, 1987

[54] PICTURE FRAME WITH TABLE TOP SUPPORT ELEMENT

[75] Inventor: Pietro Astolfi, Bologna, Italy

[73] Assignee: Pico-Glass S.p.A., Italy

[21] Appl. No.: 748,737

[22] Filed: Jun. 25, 1985

[51] Int. Cl.[4] ..... A47G 1/06

[52] U.S. Cl. ..... 40/152.1; 40/156; 248/473; 248/488

[58] Field of Search ..... 40/152.1, 156; 248/469, 248/473, 488, 468

[56] References Cited

U.S. PATENT DOCUMENTS

| | | | |
|---|---|---|---|
| 599,799 | 3/1898 | Scott | 248/473 |
| 2,125,191 | 7/1938 | Moore | 40/152.1 |
| 2,524,647 | 10/1950 | Baldwin | 248/468 |
| 2,630,992 | 3/1953 | Seelman | 40/152.1 |
| 2,665,611 | 1/1954 | Smith | 248/469 |
| 3,994,050 | 11/1976 | Bub | 248/468 |
| 4,229,892 | 10/1980 | Hueter et al. | 40/152.1 |
| 4,282,668 | 8/1981 | Jolkovski | 248/488 |

FOREIGN PATENT DOCUMENTS

| | | | |
|---|---|---|---|
| 280787 | 2/1952 | Switzerland | 40/152.1 |

*Primary Examiner*—Robert P. Swiatek
*Assistant Examiner*—Cary E. Stone
*Attorney, Agent, or Firm*—Darby & Darby

[57] ABSTRACT

A table top support for a picture frame includes a U-shaped lower portion, an inwardly sloping portion joined to the lower portion and an extended portion joined to the inwardly sloping portion. The table top support is adapted to support a picture frame having a back panel and a front transparent cover disposed adjacent to the back panel. The U-shaped lower portion of the table top support includes a front piece and a rear piece. The rear piece has a greater height than the front piece. The inwardly sloping portion extends towards the center of the back panel of the picture frame and engages the back panel. The extended portion is disposed substantially at a right angle to the back panel of the frame.

3 Claims, 4 Drawing Figures

FIG. 1
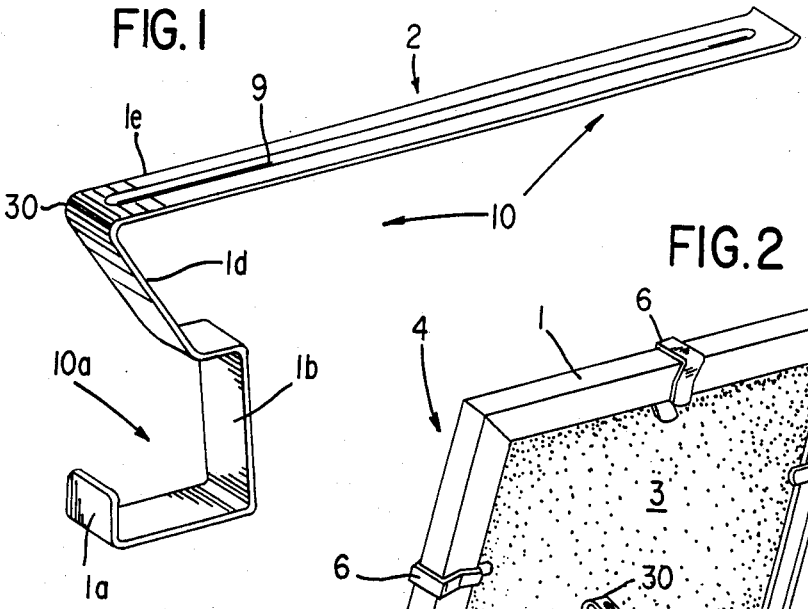
FIG. 2
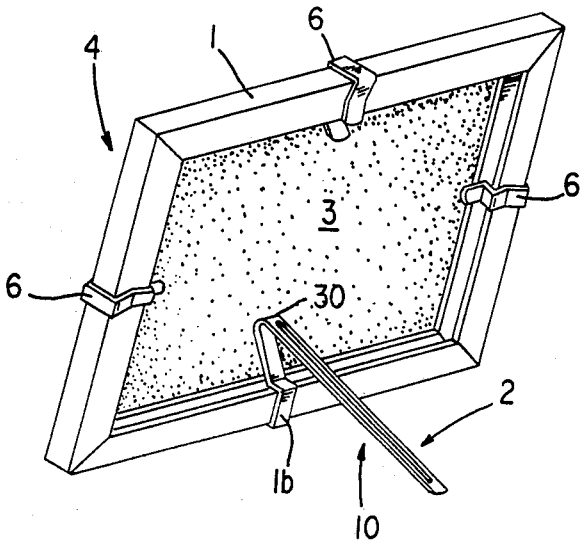
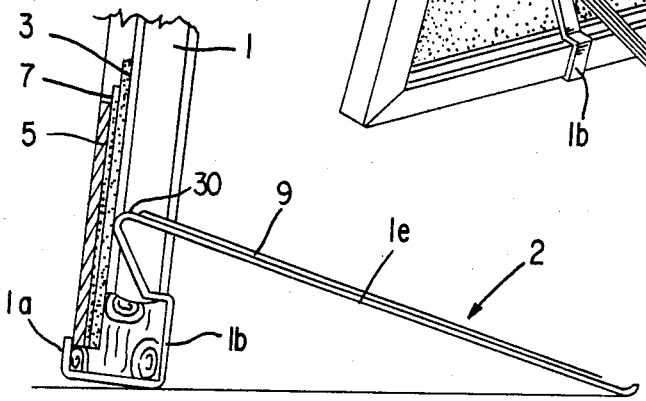
FIG. 3
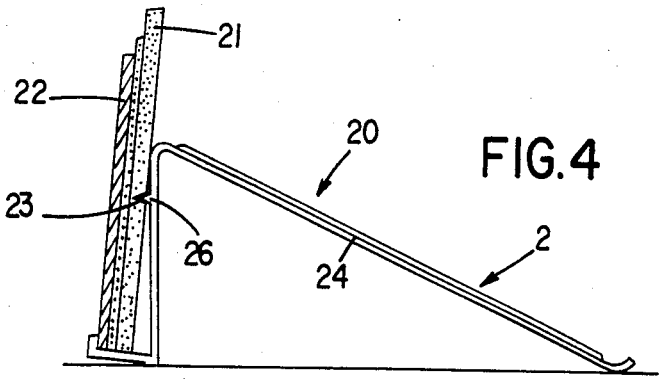
FIG. 4

PICTURE FRAME WITH TABLE TOP SUPPORT ELEMENT

BACKGROUND OF THE INVENTION

1. Field of the Invention

The invention relate to a picture frame with a table top support element. The aforementioned fits into the category of practical, economical, ordinary frames, or rather those frames which are pre-assembled and easy to use.

2. Description of the Prior Art

Conventional frames such as mentioned above have, as a part of their structure, a frame, a back board on which is positioned the picture to be displayed and lastly a protective piece of glass in front.

The aforementioned elements are secured to the frame by means of a number of clips which hold the elements together, placed around the edge.

In the majority of cases such conventional frames are hung on walls by means of one of the aforementioned clips for which no supporting element is supplied. One solution has been to use an extension from the back of the frame itself extending from the back-board to the area of support, such extension normally being hinged with the possibility of being folded flat.

This evidently results in the fact that such frames present problems of an economical and functional nature which in part prejudices their use: economical in the sense that the link to the back-board necessarily brings about an increase in the assembly costs during production, and functional in that the extension attached to the back-board is not very stable or safe, the latter being very narrow and made of material which is not very durable.

OBJECTS AND SUMMARY OF THE INVENTION

The objective of the present invention is that of avoiding the difficulties stated above by realizing a table support for picture frames which can be attached directly by the user and therefore doesn't affect the overall cost of the frame and which from the front looks like the other fixing clips, without altering in any way the aesthetic effect of the frame and therefore using the practical and functional aspects of the same.

In the ambit of this aim it is an important objective of the present invention to conceive an element of simple, economical construction which is easily manufactured.

These aims, and others, which will be explained in greater detail further on, are attained by the present invention, in which the picture frame is composed of at least a back panel on which the picture is placed and at least a piece of glass in front for covering and protecting the picture, said frame being also supplied with a number of clips arranged around the edge of the same in such a way as to hold together in one block the above-mentioned elements, characterised by the fact that at least one of the clips, acting as a support, is equipped with an extension developed more or less at a right angle to the board, and meeting at the lower back of the same.

Further characteristics and advantages will become more evident from the detailed description which follows of a preferred form of execution of the present invention, but not limiting to the specific embodiments described and shown.

BRIEF DESCRIPTION OF THE DRAWINGS

FIG. 1 shows the support of the present invention in perspective;

FIG. 2 shows a perspective of the back of the frame to which the support as shown in FIG. 1 has been attached;

FIG. 3 shows a transverse cross-section of FIG. 2.

FIG. 4 shows a possible alternative of a support in use in a partial lateral angle.

DETAILED DESCRIPTION OF THE PREFERRED EMBODIMENTS

With reference to the drawings, a picture frame 4 is shown with table support 10. The frame 4, which has already been described, is composed of a frame 1 with a closed border, a back panel 3 on which is placed the picture 7, and a piece of glass 5 to cover and protect the picture 7; the frame 1 has around the front and around the edges a groove with the function of containing and keeping together the above-mentioned components. To fix the glass, picture 7, and back panel 3 to the frame 1, ordinary clips 6 are used to be placed, as shown in FIG. 2, around the edge of the frame 4 in a regular manner in such a way so that they embrace the frame 1 and with it also a small portion of the glass, securing, in this way, everything in a stable position, as shown in FIG. 3.

In accordance with the present invention, at least one of the the clips 6 may be used and modified in such a way so it can be used as a table support 10 of the frame 4. In this case the clip 6 is supplied with, as shown in FIG. 1, an extension 2 developing itself substantially at a right angle to panel 3 and consequently to frame 4.

In other words, the clip with the stand function 10 presents the lower part 10*a* in a form which is substantially a "U", embracing the frame 1, with the front piece 1*a* in contact with the glass 5, shorter than the remaining rear section 1*b*, the latter continuing with section 1*d* developing towards the centre of the frame 4 (and consequentially towards and against the back panel 3 up to a certain height) and with a further and final section 1*e* making up the said extension 2 of the support 10.

Moreover, the section 1*e* has a reinforced rib 9 lengthways and at the end a slight upwards curve (as shown in FIGS. 1, 2 and 3) to help with the placing of the frame on the table.

FIG. 4 shows a possible alternative embodiment of the present invention. A support 20 adapted to that type of frame frequency used, simply a back board 21 and a piece of glass at the front 22 for closing, everything held together with a number of clips more or less conforming to a "7" shape and with a point which can be inserted in corresponding incisions made in the rear panel.

It is clearly shown by FIGS. 2 and 3 that the inwardly sloped portion 1*d* and the extended portion 1*e* define a pointed section 30. FIG. 3 illustrates that in the assembled condition of the invention the pointed section 30 presses the back panel 3 and the frame 1 against the picture in a spring like manner.

In this embodiment the clip support 20 is equipped with, along the major section thereof, a point 26 for inserting into the said incisions 23 from which originates a second section 24 being the extension 2.

It is important to note that, for both embodiments, the rear section of the support must extend after meeting with the back panel 3-21 for a height which must be proportional to the dimensions of the frame in order that the same may assume a stable supported position on the table; the same goes for extension 2.

Thus the item in question meets the stated requirements, in that the support results in being economical, long-lasting, and above all, uses prevalently the structure of a standard clip without in any way altering the final aesthetic effect.

The last but not least advantage of the present invention results from the fact that the support 10-20 requires only little time to mount the same on the frame, as opposed to conventional supports in, and the user himself will be able to decide whether to use the frame either hung or placed on a table top by using the standard clip provided with the frame or by using one or more supports of the present invention by simply attaching the support in an extremely simple operation.

Various modifications of the present invention may be realized by one skilled in the art without departing from the scope of the spirit of this invention the circle of

What is claimed is:

1. In combination:

a picture frame having a back panel, and a front transparent cover disposed adjacent to the back panel, the back panel and the front transparent cover being adapted to receive a picture therebetween, a plurality of clips positioned about the periphery of the cover and back panel to hold the cover and back panel together; and a table top support for the picture frame, the support including a U-shaped lower portion having a front piece and a rear piece, the rear piece having a greater height than the front piece, the U-shaped lower portion being adapted to receive the front cover and back panel between the front and rear pieces, an inwardly sloped portion joined to and forming a well-defined angle with the rear piece of the U-shaped portion, the inwardly sloped portion extending towards the center of the back panel and engaging the back panel, and an extended portion joined to the inwardly sloped portion to define a pointed section extending towards the center of the back panel, the extended portion being disposed substantially at a right angle to the back panel of the frame, the back panel having a rear surface, and a plurality of incisions formed in the rear surface, and the pointed section having adapted to engage at least one of the incisions on the back panel.

2. The combination defined by claim 1, wherein the extended portion includes at least one reenforcing rib extending longitudinally thereon.

3. The combination defined by claim 1, wherein the support further includes a curved tip formed at an end of the extended portion.

* * * * *